US011470938B2

(12) United States Patent
Fereyre et al.

(10) Patent No.: US 11,470,938 B2
(45) Date of Patent: Oct. 18, 2022

(54) DEVICE FOR TREATING HAIR

(71) Applicants: L'OREAL, Paris (FR); SEB S.A., Ecully (FR)

(72) Inventors: Régis Fereyre, Chavanay (FR); Franck Mandica, Francheville (FR); Stefania Nuzzo, Paris (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 346 days.

(21) Appl. No.: 14/438,838

(22) PCT Filed: Oct. 28, 2013

(86) PCT No.: PCT/IB2013/059720
§ 371 (c)(1),
(2) Date: Apr. 27, 2015

(87) PCT Pub. No.: WO2014/064660
PCT Pub. Date: May 1, 2014

(65) Prior Publication Data

US 2015/0289622 A1 Oct. 15, 2015

(30) Foreign Application Priority Data

Oct. 26, 2012 (FR) ..... 12 60238

(51) Int. Cl.
*A45D 19/16* (2006.01)
*A45D 1/04* (2006.01)
(Continued)

(52) U.S. Cl.
CPC ..... *A45D 19/16* (2013.01); *A45D 1/04* (2013.01); *A45D 1/06* (2013.01); *A45D 1/18* (2013.01);
(Continued)

(58) Field of Classification Search
CPC .. A45D 2200/056; A45D 11/051; A45D 1/16; A45D 1/04; A45D 1/06; A45D 1/14;
(Continued)

(56) References Cited

U.S. PATENT DOCUMENTS 1,487,374 A * 3/1924 De Bassini ..... A45D 24/24 132/108
2,880,299 A * 3/1959 Jones ..... A45D 1/04 132/232
(Continued)

FOREIGN PATENT DOCUMENTS

CN 1630478 A 6/2005
CN 1768640 A 5/2006
(Continued)

OTHER PUBLICATIONS

Feb. 6, 2014 Search Report issued in International Application No. PCT/IB2013/059720.
(Continued)

*Primary Examiner* — Cris L. Rodriguez
*Assistant Examiner* — Brianne E Kalach
(74) *Attorney, Agent, or Firm* — Oliff PLC

(57) ABSTRACT

The invention relates to a device for treating, especially styling, hair, comprising: a receptacle (25) containing a product to be applied, said product being contained in the receptacle in a fluid state; two jaws (3, 4) that are movable in relation to each other and can adopt a spread configuration for the insertion of a lock of hair therebetween and a closed configuration for treating the lock of hair, said jaws (3, 4) being movable along the lock of hair in said closed configuration; an application body (23) for applying the cosmetic product, carried by one of said jaws and suitable for coming into contact with the hair in the closed position; and
(Continued)

Figure 1:
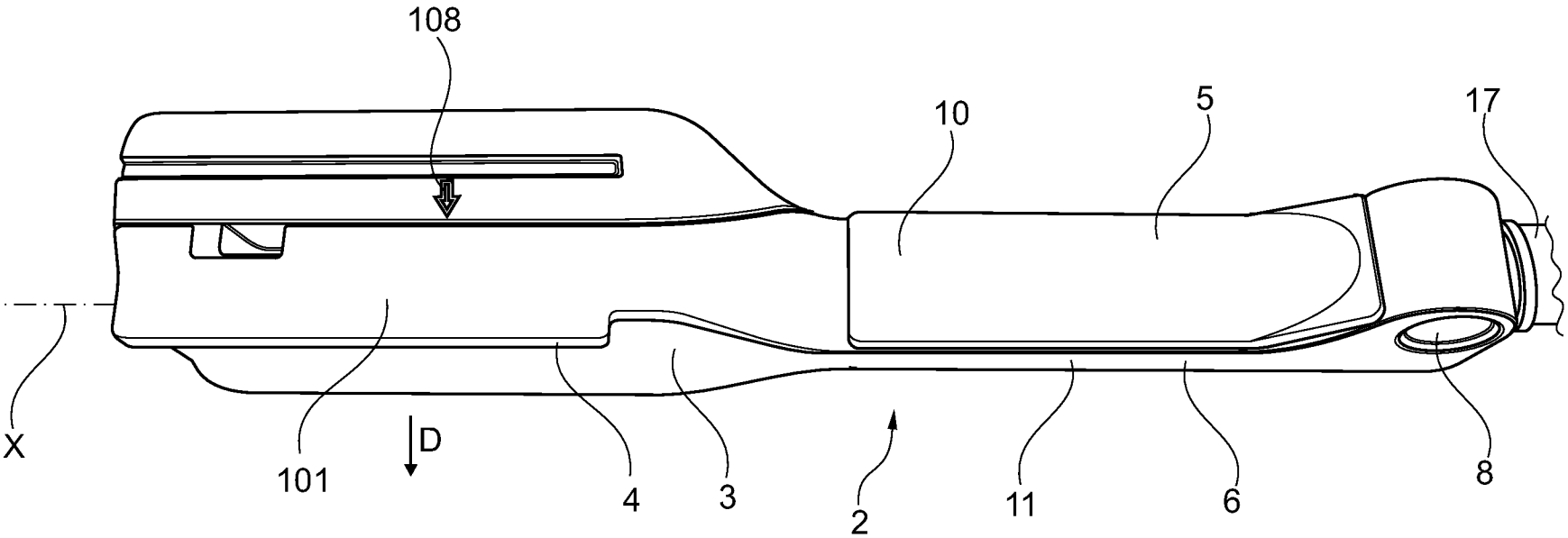

a steam outlet (21) on the other one of said jaws, for exposing the hair engaged in the device to the steam.

27 Claims, 9 Drawing Sheets

(51) Int. Cl.

| | |
|---|---|
| ***A45D 2/00*** | (2006.01) |
| ***A45D 1/06*** | (2006.01) |
| ***A45D 1/18*** | (2006.01) |
| ***A45D 7/06*** | (2006.01) |
| *A45D 1/00* | (2006.01) |

(52) U.S. Cl.
CPC ..... *A45D 2/001* (2013.01); *A45D 2/002* (2013.01); *A45D 7/06* (2013.01); *A45D 2001/008* (2013.01)

(58) Field of Classification Search
CPC ..... A45D 1/001; A45D 2/001; A45D 24/22; A45D 24/26; A45D 24/24
See application file for complete search history.

(56) References Cited

U.S. PATENT DOCUMENTS

| | | | | |
|---|---|---|---|---|
| 5,307,826 | A * | 5/1994 | Iosilevich | A45D 40/262 132/218 |
| 5,913,315 | A * | 6/1999 | Todd | A45D 2/40 132/206 |
| 6,941,955 | B2 * | 9/2005 | Yao | A45D 1/04 132/225 |
| 7,465,904 | B2 * | 12/2008 | Kim | A45D 1/04 132/228 |
| 8,129,661 | B2 * | 3/2012 | Catini | A45D 2/001 219/225 |
| 8,561,620 | B2 * | 10/2013 | Morgandi | A45D 1/04 132/224 |
| 2002/0036000 | A1 * | 3/2002 | Hirata | A45D 1/00 132/224 |
| 2004/0000319 | A1 * | 1/2004 | Carballada | A45D 1/04 132/224 |
| 2004/0035435 | A1 * | 2/2004 | Glucksman | A45D 19/02 132/114 |
| 2004/0163661 | A1 * | 8/2004 | Carlucci | A45D 1/04 132/222 |
| 2006/0144414 | A1 * | 7/2006 | Carballada | A45D 1/04 132/224 |
| 2009/0019719 | A1 * | 1/2009 | Yde | A45D 20/12 34/96 |
| 2009/0114240 | A1 * | 5/2009 | Leung | A45D 1/06 132/224 |
| 2009/0188516 | A1 * | 7/2009 | Catini | A45D 1/02 132/269 |
| 2010/0101599 | A1 * | 4/2010 | Choi | A45D 1/04 132/269 |
| 2010/0242986 | A1 * | 9/2010 | Serresvives | A45D 1/04 132/227 |
| 2010/0307528 | A1 | 12/2010 | Restle et al. | |
| 2012/0111355 | A1 * | 5/2012 | Vacheron | A45D 1/04 132/228 |

FOREIGN PATENT DOCUMENTS

| | | | |
|---|---|---|---|
| FR | 2921803 | A1 | 4/2009 |
| FR | 2921805 | A1 | 4/2009 |
| JP | 2005-530581 | A | 10/2005 |
| KR | 20-0132060 | Y1 | 12/1998 |
| WO | 2004/002262 | A1 | 1/2004 |
| WO | 2004/002263 | A1 | 1/2004 |
| WO | WO2004054403 | * | 7/2004 |

OTHER PUBLICATIONS

Feb. 6, 2014 Written Opinion issued in International Application No. PCT/IB2013/059720.
Aug. 13, 2013 Written Opinion issued in French Patent Application No. 1260238.
Oct. 15, 2019 Office Action issued in Korean Appliation No. 10-2015-7013637.
Jan. 4, 2017 Office Action issued in Chinese Application No. 201380068580.1.

* cited by examiner

DEVICE FOR TREATING HAIR

The present invention relates to devices for treating the hair, and more particularly, but not exclusively, those intended for shaping the hair, in particular for straightening, curling or crimping the hair.

The invention relates more particularly to devices comprising two jaws that are able to move with respect to one another and are able to take up a spaced-apart configuration for introducing a lock between said jaws and a moved-together configuration for treating the lock, the jaws being movable along the lock in this moved-together configuration. In such devices, the jaws frequently carry two heating elements with which the hair is brought into contact during the use of the device.

BACKGROUND

Numerous devices of this type, sometimes also known as straightening irons, have already been proposed, implementing the spraying of steam onto the hair.

Thus, the publication US 2010/0242986 discloses a device for treating the hair, in which steam is produced independently of the heating elements with which the hair comes into contact. A reservoir can contain a cosmetic composition, such as a shaping agent or dyeing agent, to be applied to the hair in order to exert an action thereon in addition to the steam treatment.

The patent application US 2010/0307528 teaches various hair treatment processes that use steam and can comprise a step of applying a cosmetic product.

The application EP 1 652 445 A1 discloses a device for the heat treatment of hair which implements the production of steam. No cosmetic product is applied by the device.

The publication WO 2004/002262 A1 describes a hair treatment device in which the steam is sprayed along two parallel ramps, or even on both sides of the lock of hair. A cosmetic treatment additive can be used in the reservoir, which serves to produce steam, thereby limiting the active agents that are able to be used.

The publications WO 2004/002263 A1 and US 2004/0000319 disclose a device in which a cosmetic shaping agent is sprayed in the form of droplets onto the hair.

The U.S. Pat. No. 6,325,072 B1 describes a device for treating the hair in which one of the arms carries a steam generator and the other arm a pad impregnated with a cosmetic product in a solid form. The steam is sprayed onto the pad, which is moistened, thereby activating the product and allowing it to be deposited on the hair. The use of a solid cosmetic product causes limitations with regard to the active agents that can be chosen. Moreover, this makes it necessary to dispose the steam outlet opposite the pad, and this can reduce the surface area for exchange with the hair, which is at the same time in contact therewith.

Some other devices combine a thermal action and product application, but without subjecting the hair to a steam treatment. Thus, for example, the publication WO 2009/078046 A1 or the application US 2009/0025247 A1 disclose devices for the heat treatment of the hair, without application of steam.

There is a need to further improve devices for treating the hair, in particular in order to benefit from an efficient device that is simple and comfortable to use, operates reliably and has a cost compatible with widespread distribution.

SUMMARY

According to a first of its aspects, a subject of the invention is a device for treating, in particular shaping, the hair, comprising:

- two jaws that are able to move with respect to one another and are able to take up a spaced-apart configuration for introducing a lock of hair between said jaws and a moved-together configuration for treating the lock of hair, the jaws being movable along the lock in this moved-together configuration,
- a reservoir containing a cosmetic product to be applied to the hair, this product being in the fluid state,
- an applicator member for applying said cosmetic product, said applicator member being carried by one of said jaws,
- a steam outlet on the other of said jaws, for exposing the hair introduced between the jaws to steam.

The expression "in the fluid state" should be understood as meaning liquid at room temperature (25° C.) or a higher temperature, between 25 and 50° C. for example. In this case, the product can initially be in the solid or pasty state at room temperature in the reservoir and be heated up within the reservoir in order to make it sufficiently fluid to be dispensed by the dispensing mechanism provided to supply the applicator member. The product is thus fluid in the reservoir at the time of application.

The reservoir may be equipped with an electrical resistor, for example a fine screen-printed resistor, making it possible to bring the temperature of the contents thereof to 40-50° C., for example.

The presence of the steam outlet on one of the jaws and the applicator member on the other of said jaws allows a relatively balanced construction of the device as far as the part thereof that is handled by the user during treatment, also referred to as "handpiece", is concerned. In particular, the reservoir is advantageously disposed on the same side as the jaw carrying the applicator member, and its weight makes it possible to balance the device even more effectively. This can facilitate manipulation of the device and ease of use and can make the reservoir more easily accessible to the user, thus simplifying the operation of refilling the device with product. These advantages can be obtained without otherwise unduly limiting the options of arranging different treatment members within the device, depending on the order in which it is desired for the device to carry out the various steps for treating the hair. The fact that a cosmetic product in a fluid form is used makes it possible to supply the applicator member in a dosed manner, if desired, using any suitable means of dispensing a liquid. The steam outlet does not have to be located exactly opposite the product application member, thereby making it possible to enlarge the surface area for exchange and the effectiveness of the treatment.

Preferably, in particular when the hair is intended to be straightened, the device comprises a heating element intended to come into contact with the hair, and better still two heating elements, each disposed on a jaw. This or these heating element(s) may each comprise a plate, made of a material that is a good conductor of heat, that defines a hot surface for bringing into contact with the hair, the temperature of said surface being for example greater than 50° C., better still between 90 and 230° C.

The device may comprise two arms that are able to move with respect to one another, carrying the jaws; these two arms are preferably articulated together and define two half-handles on the side of the articulation, the user being able to press on said half-handles in order to move the jaws together. The reservoir is advantageously housed under one of the half-handles, this making it possible to move the center of gravity of the handpiece toward the articulation and improving ease of use, or even being able to make it possible to avoid providing a balancing weight.

The arm comprising the steam outlet advantageously carries an evaporation chamber and a resistive element disposed within the latter. This resistive element produces heat independently of the heating element(s) used otherwise for thermally treating the hair by contact with a hot surface, in particular for straightening it.

The applicator member for applying cosmetic product is disposed so as to come into contact with the hair. The jaw opposite the one that carries the applicator member may define a counter-bearing surface such that the hair is pressed against the applicator member with a certain pressure by the counter-bearing surface. The applicator member for applying cosmetic product is preferably porous, elastically compressible, and may advantageously be made of an open-cell cellular material, such as a PE (polyethylene) foam, for example. The applicator member may be made of any material that is able to release or diffuse the cosmetic product. The fact that the hair is compressed against the applicator member can improve the quality of coating of the hair with product. The applicator member is preferably single-use, being replaced from one hair treatment to another.

When it is initially mounted on the device, it is possible for the applicator member not to contain any cosmetic product at all, thereby making it easier to package and handle.

Preferably, the device is produced such that the applicator member is supplied automatically with product while the device is being used. Thus, the user does not have to worry about exerting a particular action on the device in order to apply the product.

More preferably, this supplying with product takes place by virtue of a dispensing mechanism that is actuated automatically when the jaws are moved together. Each time the jaws are moved together, this can thus cause a dose of product to be dispensed. It is particularly advantageous for the force necessary to actuate the dispensing mechanism to be exerted by the user, since this makes it possible to avoid using an electric motor, and thus to reduce the cost of the device.

The device may comprise a, preferably manual, adjusting member for modifying the flow rate at which the applicator member is supplied with product, the adjusting member acting, preferably, on the dispensing mechanism.

The applicator member for applying cosmetic product is preferably supplied with product with a provisional accumulation of product under pressure, this continuing once the jaws have been moved together, so as to make it possible to continue to supply the applicator member with product while the device is moved along a lock of hair.

The applicator member is advantageously supplied by a dispensing end piece that is capable of filling with product during the actuation of the dispensing mechanism by increasing in volume by elastic deformation. Thus, product can collect in the dispensing end piece in order to be dispensed once the filling action has stopped. This delayed supplying of the applicator member can avoid the need to collect a large amount of product within the applicator member itself, and thus to reduce losses of product during the changing thereof. If desired, the applicator member may be realized with a relatively small thickness, for example less than or equal to 10 mm.

In one implementation example of the invention, the dispensing end piece is realized with an elastically deformable wall so as to expand during filling and to deliver the product after the filling action has stopped, returning to its initial shape.

Preferably, one or more dispensing orifices are produced in the dispensing end piece in the form of slots having edges that are joined at rest. These slots can open under the pressure of the upstream product and then close in a sealed manner, thereby ensuring good preservation of the product. These slots are preferably produced by being cut out.

The heating element(s) preferably has/have an elongate shape in a direction perpendicular to the direction of movement of the device over the lock of hair introduced between the jaws; the same advantageously goes for the applicator member. The length of the heating elements and of the applicator member preferably corresponds to the entire width of the lock to be treated, and is for example between 70 and 110 mm.

The steam outlet is advantageously defined by a ramp for spraying steam, extending in a direction perpendicular to the direction of the movement of the device over the lock, along substantially the same length as the heating element(s) and the applicator member. The quantity of steam delivered is for example less than or equal to 5 $gmin^{-1}$ and better still between 2.5 and 4.5 $gmin^{-1}$.

The capacity of the cosmetic product reservoir is for example between 5 and 20 mL, better still between 7.5 and 12.5 mL.

Preferably, the reservoir and the system for supplying the applicator member with product belong to one and the same assembly forming a refill, this being able to be handled in one piece in order to be fitted on the device and removed therefrom; refilling with product is rendered easier as a result. This assembly may comprise a part of the dispensing mechanism, for example in the form of a flexible duct disposed so as to be able to be pinched and deformed in order to expel the product contained in the interior toward the applicator member, the other part being carried by the rest of the device, for example comprising a pressing element that is applied to the flexible duct and is actuated when the jaws are moved together. In one implementation example of the invention, this pressing element is actuated by a relief, the position of which is adjustable by the user with the aid of the adjusting member so as to vary the quantity of product dispensed.

If appropriate, the device may comprise a double steam outlet at two locations that are spaced apart from one another in the direction of movement over the hair, so as to realize a double steam treatment, this having in particular the advantage of being able to volumize the hair during the first steam treatment, which can take place prior to the application of the cosmetic product, and then of improving the penetration of the product into the hair during the second steam treatment, following the application of the product.

There may be two heating elements on at least one of the jaws, this making it possible to multiply the possible treatment combinations.

According to another of its aspects, a further subject of the invention is an assembly that forms a refill, suitable in particular for a treatment device according to the invention, as defined above, but likely also to be suitable for other devices for treating the hair that do not necessarily involve production of steam or carry out a heat treatment, comprising two jaws that are closed over a lock of hair and a mechanism for dispensing the product, actuated by the movement of the jaws.

This assembly that forms a refill may comprise a reservoir filled with cosmetic haircare product, the applicator member and the system for supplying the applicator member from the reservoir; this supply system may comprise, as mentioned above, a flexible duct intended to cooperate with a pressing element and a dispensing end piece making it possible to deliver the product at the applicator member. The dispensing end piece is advantageously as defined above. Thus, the dispensing end piece may comprise dispensing orifices such as slots, which are closed at rest and open under the pressure of the upstream product, and have an elasticity that allows an increase in volume during filling and dispensing of product that continues after the end of the filling action. The assembly that forms a refill may be designed to be fixed, preferably by snap-fastening, to the corresponding arm, comprising for example a casing in which the reservoir and the supply system are contained. The assembly that forms a refill may at least partially define the back of one of the arms, or be housed under a shell that defines the back of the arm, thereby making it possible to use a more fragile material for the assembly that forms a refill.

If appropriate, the applicator member may be mounted in a removable manner on the assembly that forms a refill; in a variant, the applicator member may be fixed to the arm independently of the assembly that forms a refill and it is possible for the latter not to comprise the applicator member. If appropriate, the device may comprise means that make it easier to eject the applicator member in order to replace the latter, such as an ejector pushbutton.

The device may be configured not to operate when the assembly that forms a refill contains a quantity of product less than a predetermined quantity or when the assembly that forms a refill is not on the device. The device may comprise a system for recognizing the presence of the assembly that forms a refill on the device, preventing the latter from operating when the element that forms a refill is missing, and a system for stopping the device, associated in particular with a counter, which prevents the device from operating after a predefined number of closures of the jaws generating the application of a dose of product.

The reservoir may contain the product in the free state therein, that is to say that the liquid does not impregnate any porous element in the reservoir.

In a variant, the reservoir comprises an absorbent element impregnated with product prior to use and the absorbent element may carry the applicator member. Preferably, the applicator member is impregnated with product prior to the first use.

The applicator member may be defined by a part of the absorbent element in contact with the lock of hair in the closed position of the jaws. In this case, it should be understood that the applicator member is supplied with product by the reservoir in that the product can diffuse by capillary action from the absorbent element within the reservoir to the applicator member.

Preferably, the absorbent element is porous. Very particularly, the porous element may be made of felt, in particular when one and the same piece serves both to form a reserve of product in the reservoir and as an applicator member by coming into contact with the hair. The absorbent element may be made of any material that is able to store and release or diffuse the cosmetic product. The reservoir and the applicator member form an assembly that forms a refill that is able to be handled in one piece in order to be fitted on the device and removed therefrom, in particular by sliding on the jaw. The assembly that forms a refill may in particular be fitted on the jaw that carries it by being slid into a lateral housing of said jaw. The assembly that forms a refill may comprise a shell that defines a support, the product being contained in a one-piece component of which a part forms the applicator member. It is possible for the support not to be closed in order to allow said part that forms an applicator member to come into contact with the hair. This part that forms an applicator member may be permanently uncovered or be covered by a closure cap when the device is not being used to apply the product to the hair.

A comb is advantageously disposed on one of the arms, preferably downstream of the application of cosmetic product. Thus, the comb can help to homogenize the application of the product to the hair by spreading any excess of product thereover. The comb can be mounted in a removable manner, so as to make it easier to clean. If appropriate, a number of combs having different tooth spacing are proposed, in order to allow the user to choose the one which is most suitable for his or her hair.

The counter-bearing surface may be defined by a block carried by the jaw opposite the one carrying the applicator member, in particular facing the applicator member when the jaws are closed. The block may be able to move relative to the jaw which carries it and its movement may be controlled, at least partially, by the adjusting member.

The adjusting member may be adjusted into a position in which the dispensing mechanism is not actuated, in particular during the use of a dose or when the device is not being used. The position in which the dispensing mechanism is not actuated may move the block into a position of maximum compression of the applicator member on closure of the arms. This position makes it possible, in particular, to wipe the applicator member.

The block may be a porous element, in particular made of felt, which is impregnated with product prior to use. The block then constitutes a second applicator member for applying product.

Thus, in one implementation example of the invention, the device may comprise two felts that are disposed respectively on the upper and lower jaws, between which the hair passes while the device is being used. Preferably, the felts are impregnated with one and the same cosmetic product, but in a variant, the products are different. The felts may be replaced with porous blocks, for example frits or open-cell foams, which are impregnated with product.

The device may comprise a removable protective cover that is able to cover the applicator member in order not only to prevent the application of cosmetic product to the hair when this is necessary but also to protect the applicator member, in particular the residual product it contains, from the outside environment after use.

Preferably, the protective cover, when it is in place, covers the entire surface of the applicator member, being secured or not secured to the device in a permanent manner.

The counter-bearing surface may be realized so as to comprise a removable cover which, in order to prevent the application of cosmetic product to the hair, can take up a configuration in which it serves as a protective cover for the applicator member.

Treatment Processes

A further subject of the invention is a process for treating the hair with the aid of a device according to the above first aspect of the invention, wherein, while the device is being moved along a lock of hair, the latter is exposed, in a single operation, to an application of steam, of cosmetic product and to heating in contact with a hot surface. A lock can be treated in a single pass.

A further subject of the invention is a process for the cosmetic treatment of the hair, in particular with the aid of a device according to the first aspect of the invention, in which a cosmetic haircare product is applied to and a steam treatment is carried out on a lock of hair introduced into the device, wherein, in said process, steam is sprayed onto one side of the lock, for example from the lower arm, and the product is applied to the other side, for example from the upper arm, the application of the product being independent of the spraying of steam, the two being effected preferably at locations that are offset relative to the direction of movement of the device over the lock.

Additionally, a heat treatment is advantageously carried out by passing the lock through in contact with at least one heating element, better still by passing it between two heating elements located opposite one another.

Preferably, a combing action is carried out by passage through a comb disposed downstream of the location at which cosmetic product is applied and upstream of the location of the heat treatment, and preferably downstream of the location of the steam treatment.

Numerous combinations of treatments are possible; preferably, an application of product, a steam treatment, combing and a straightening heat treatment by contact with the heating element(s) are carried out in succession on one and the same portion of hair while the device is being moved over the lock. However, the following combinations of treatments can also be carried out during the passage of the device over the hair, by disposing the various treatment means in an appropriate manner:

- straightening heat treatment/steam treatment/straightening heat treatment/product application,
- product application/steam treatment/straightening heat treatment,
- straightening heat treatment/steam treatment/product application/steam treatment/straightening heat treatment,
- straightening heat treatment/product application/straightening heat treatment/steam treatment,
- product application/straightening heat treatment/steam treatment/straightening heat treatment,
- product application/straightening heat treatment/steam treatment,
- straightening heat treatment/product application/steam treatment/straightening heat treatment,
- steam treatment/product application/straightening heat treatment,
- steam treatment/straightening heat treatment/product application/straightening heat treatment.

In these various combinations, a combing step can be added, this step preferably being downstream of the first treatment and upstream of the final treatment.

Of course, the invention is not limited to a hair straightening treatment; non-lasting hair shaping (curls, waves) can also be carried out.

The product contained in the reservoir, in the free state or in a form in which it impregnates a porous element, is not limited to a straightening product, and could also be a dyeing product. The product contained in the reservoir is preferably a non-rinse product.

According to another of its aspects, which may be combined with the first, a further subject of the invention is a device for treating, in particular shaping, the hair, comprising:

- two jaws that are able to move with respect to one another and are able to take up a spaced-apart configuration for introducing a lock of hair between said jaws and a moved-together configuration for treating the lock of hair, the jaws being movable along the lock in this moved-together configuration,
- two heating elements disposed on one of the jaws in a manner spaced apart from one another, making it possible to carry out out a heat treatment by contact with the hair, in particular a straightening treatment,
- a steam outlet for exposing the hair introduced into the device to steam, the steam being produced by a vaporization member thermally independent of the heating elements, the steam outlet being located between the heating elements.

According to this aspect, the invention has the advantage of always subjecting the hair to contact with one of the heating elements following exposure to the steam, regardless of the direction of movement of the device along the hair. This particular embodiment is thus also advantageously applied to devices other than the one defined above, in accordance with the first aspect of the invention.

According to another of its aspects, which may be combined with the first, a further subject of the invention is a device for treating, in particular shaping, the hair, comprising:

- two jaws that are able to move with respect to one another, are carried by arms connected by an articulation, and are able to take up a spaced-apart configuration for introducing a lock of hair between said jaws and a moved-together configuration for treating the lock of hair, the jaws being movable along the lock in this moved-together configuration,
- one or more possible heating elements disposed on at least one of the jaws, making it possible to carry out out a heat treatment by contact with the hair, in particular a straightening treatment,
- a possible steam outlet for exposing the hair introduced between the jaws to steam, the steam preferably being produced by a vaporization member thermally independent of the heating element(s),
- a reservoir of cosmetic product,
- an applicator member for applying cosmetic product, said applicator member being supplied with product by the reservoir,
- a flexible duct through which the product flowing from the reservoir to the applicator member passes,
- a rotary pressing element that acts on the flexible duct in the manner of a peristaltic pump, this pressing element being carried by one of the arms,
- an actuating relief carried by the other arm, for actuating the pressing element,
- a member for adjusting the position of the actuating relief relative to the arm that carries it, so as to act over the extent of the angular travel over which the pressing element is actuated while the jaws are moved together.

These features are advantageous independently of the implementation of a steam treatment or heat treatment, since they make it possible to adjust the flow rate of product supplying the applicator member, while exhibiting an automatic supply of product to the applicator member.

The pressing element may first be guided by a sliding connection, preferably by sliding in slots, so as to move first of all in translation, and then by a pivoting connection so as then to pivot in order to compress the flexible duct progressively starting from the pinching zone.

According to another of its aspects, which may be combined with the first, a further subject of the invention is a device for treating, in particular shaping, the hair, comprising:

- two jaws that are able to move with respect to one another, are carried by arms connected by an articulation, and are able to take up a spaced-apart configuration for introducing a lock of hair between said jaws and a moved-together configuration for treating the lock of hair, the jaws being movable along the lock in this moved-together configuration, one or more possible heating elements disposed on at least one of the jaws, making it possible to carry out a heat treatment by contact with the hair, in particular a straightening treatment, a possible steam outlet for exposing the hair introduced between the jaws to steam, the steam preferably being produced by a vaporization member thermally independent of the heating elements, a reservoir of cosmetic product, an applicator member for applying cosmetic product, said applicator member being supplied with product by the reservoir, a deformable chamber for collecting product, interposed on the path of the product between the reservoir and the applicator member, this chamber being subjected to elastic deformation, following a filling action brought about by the jaws being moved together, in order to decrease in volume and drive the product towards the applicator member.

The chamber is formed for example by a product dispensing end piece which supplies the applicator member, this end piece having at least one product dispensing orifice that leads to the applicator member, better still a plurality of dispensing orifices distributed along the dispensing end piece, the latter being realized with an elastically deformable wall, and the dispensing orifice(s) being closed at rest; the dispensing end piece can increase in volume by elastic deformation during an action of filling the latter resulting from the relative movement of the jaws, and can continue to release the product after the filling action has stopped, returning to its initial shape. In a variant, the collecting chamber is formed by a portion of elastically deformable tube or by a diaphragm that is elastically deformable or able to move without inherent elasticity but comes into abutment against an elastic return member which deforms in order to accompany the increase in volume and which generates the pressure necessary to continue dispensing the product once the jaws have been moved together.

These features are advantageous independently of the implementation of a steam treatment or heat treatment, since they make it possible for the dispensing of product to continue once the jaws have been moved together, while the device is being moved along the lock of hair, thereby improving the homogeneity of dispensing of the product.

According to another of its aspects, a further subject of the invention is a device for treating, in particular shaping, the hair, comprising:

two jaws that are able to move with respect to one another and are able to take up a spaced-apart configuration for introducing a lock of hair between said jaws and a moved-together configuration for treating the lock of hair, the jaws being movable along the lock in this moved-together configuration, one or more heating elements disposed on at least one of the jaws, making it possible to carry out out a heat treatment by contact with the hair, in particular a straightening treatment, a steam outlet for exposing the hair introduced into the device to steam, the steam being produced by a vaporization member thermally independent of the heating elements, an applicator for cosmetic product, for example a part of a porous element such as a felt, a comb disposed on one of the jaws, between the steam outlet and the heating element(s).

The presence of the comb is advantageous, independently of the features that are the subject of the invention according to the first aspect thereof, since the comb makes it possible in particular to homogenize the product applied to the hair and increases the surface area for exchange with the steam by dividing the lock into multiple bundles.

According to another of its aspects, a further subject of the invention is a device for treating, in particular shaping, the hair, comprising:

two jaws that are able to move with respect to one another, are carried by arms connected by an articulation, and are able to take up a spaced-apart configuration for introducing a lock of hair between said jaws and a moved-together configuration for treating the lock of hair, the jaws being movable along the lock in this moved-together configuration, a reservoir containing a product to be applied, this product being contained in the fluid state in the reservoir, the reservoir comprising an absorbent element impregnated with product and carried by one of said jaws, in particular a felt, an applicator member for applying the cosmetic product, said applicator member being carried by the absorbent element, and in particular being formed by a part of said felt, and a steam outlet on the other of said jaws, for exposing the hair introduced into the device to steam.

As a result, the reservoir and the applicator member form a single piece which can be changed easily between two uses.

In addition, this configuration makes it possible to simplify the structure and to limit the quantity of product applied to that contained in the absorbent element, it being possible to adapt this quantity, if appropriate, to a single use, this possibly being useful in order to avoid the product drying out or degrading if the periods of use are spaced apart in time.

Preferably, the applicator member is impregnated with product prior to use. The applicator member may in particular be defined by the part of the absorbent element in contact with the lock of hair in the closed position.

The absorbent element is preferably porous and made of a felt.

The absorbent element may be elastically compressible.

The absorbent element may be made of any material that is able to store and release or diffuse the cosmetic product.

Preferably, the reservoir and the applicator member belong to one and the same assembly that forms a refill, this being able to be handled in one piece in order to be fitted on the device and removed therefrom.

The assembly that forms a refill may in particular be fitted on the jaw that carries it by being slid into a housing of said jaw.

The jaw opposite the one that carries the applicator member may define a counter-bearing surface such that the hair is pressed against the applicator member with a certain pressure by the counter-bearing surface.

The counter-bearing surface may be defined by a block carried by the jaw opposite the one carrying the applicator member.

The block may be a porous element, in particular made of felt, which is impregnated with product prior to use.

DETAILED DESCRIPTION OF THE FIGURES

Figure 2:
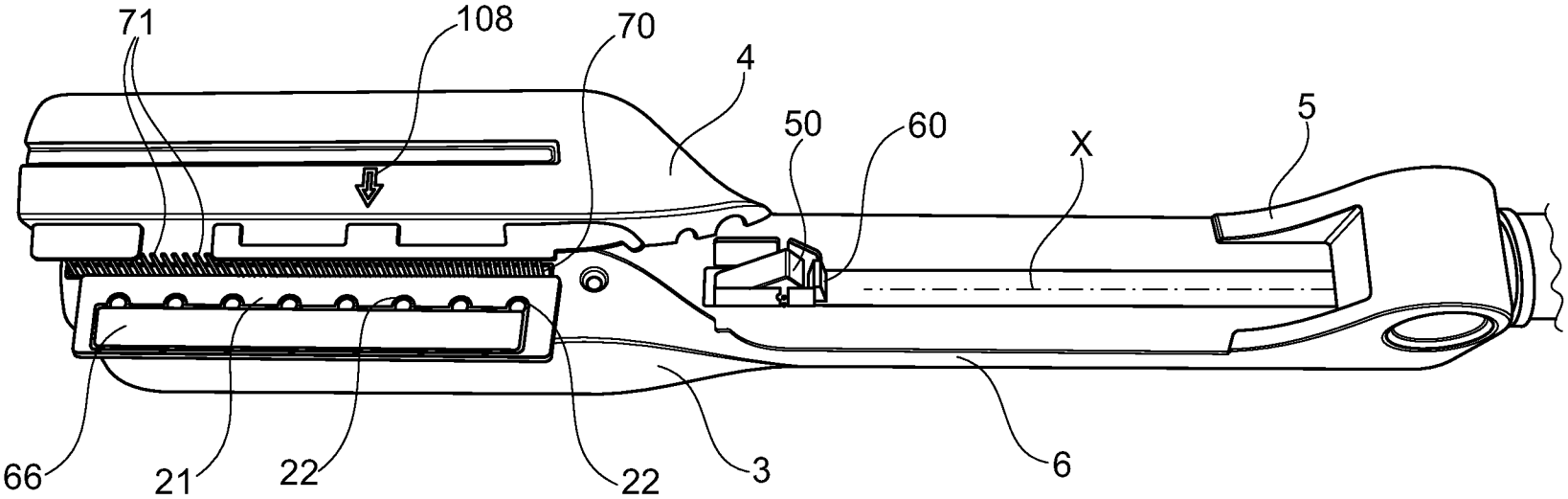
Figure 3:
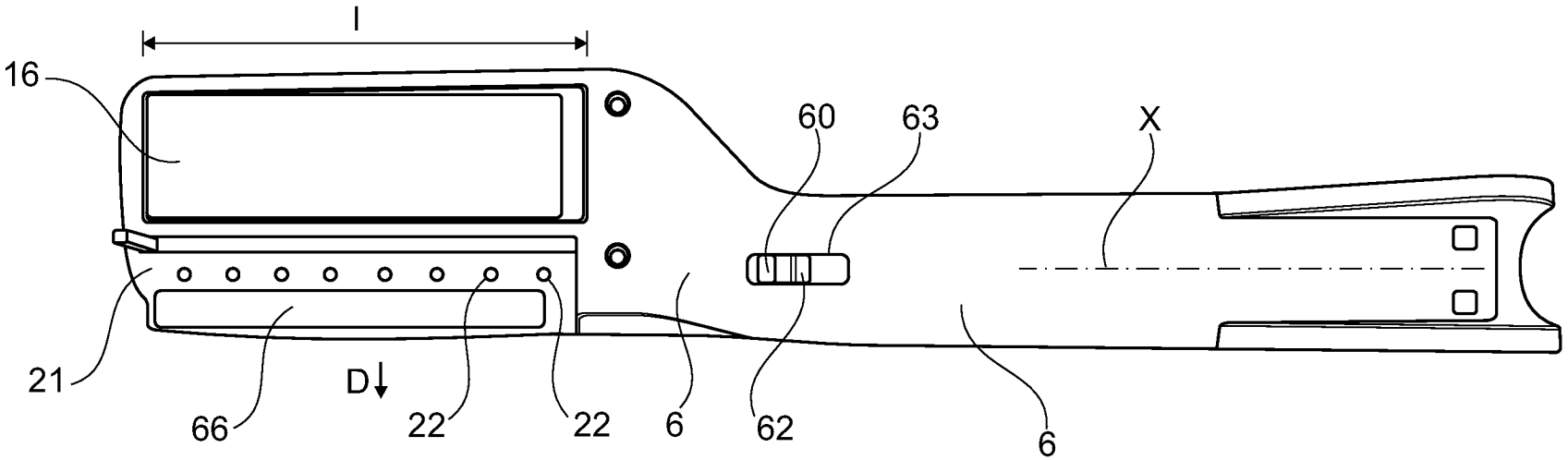
Figure 4:
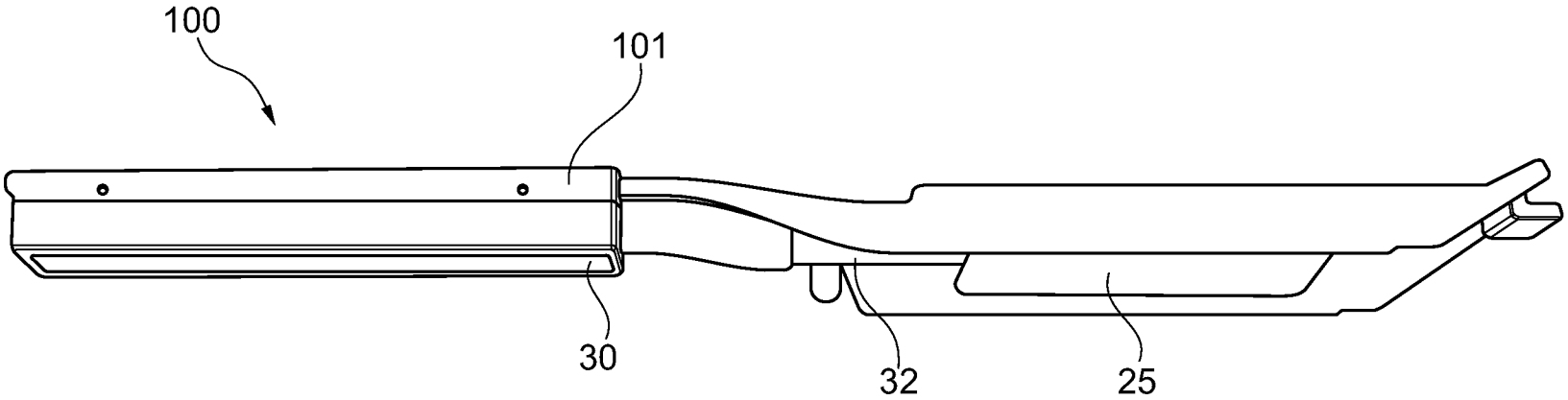
Figure 5:
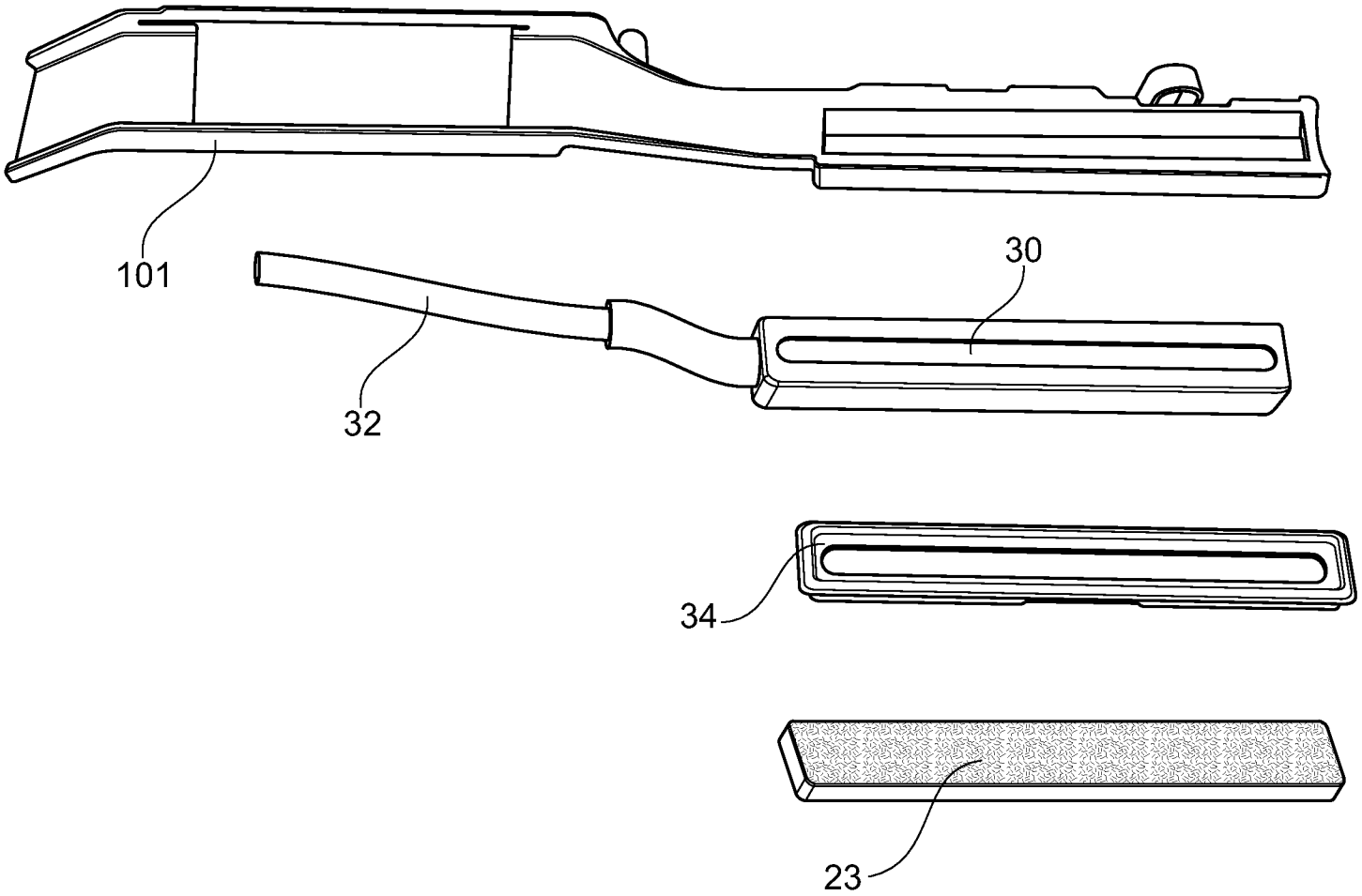
Figure 6:
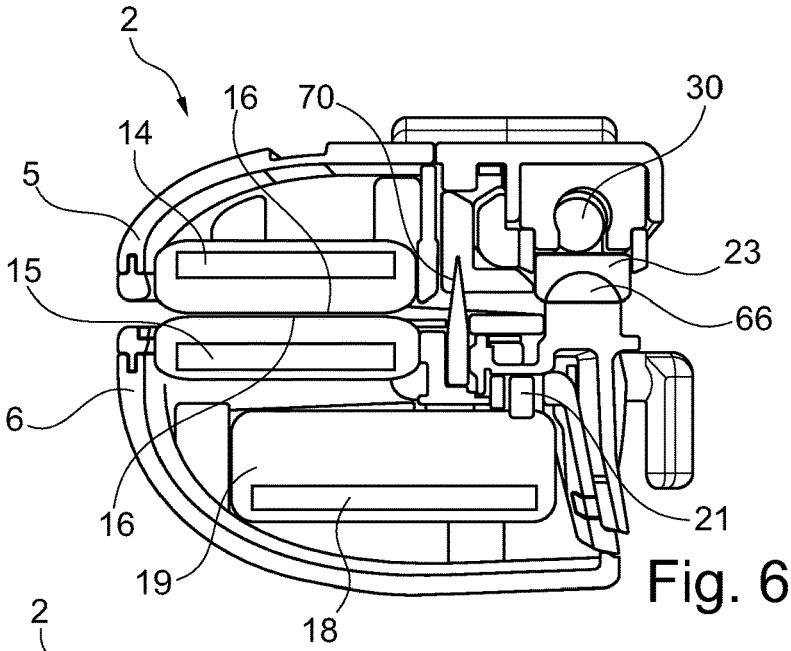
Figure 7:
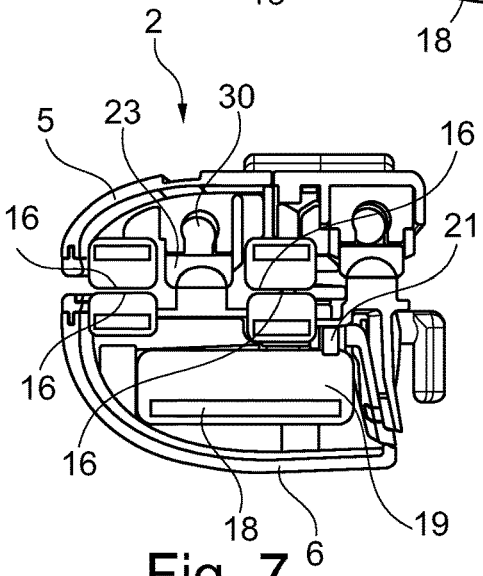
Figure 8:
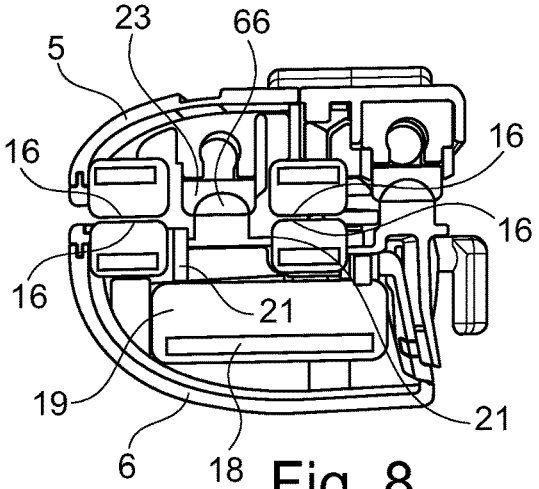
Figure 9:
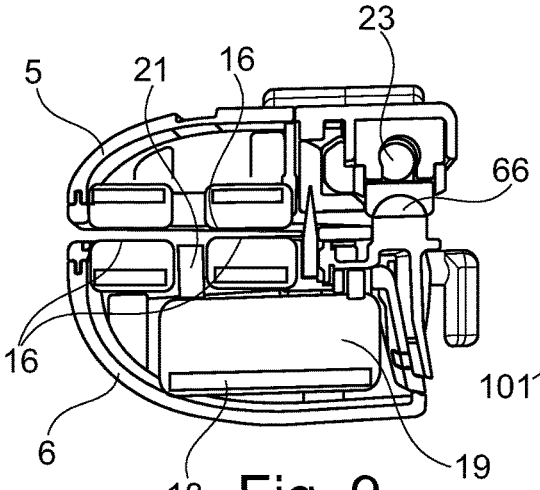
Figure 10:
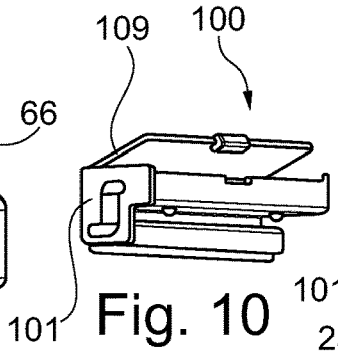
Figure 11:
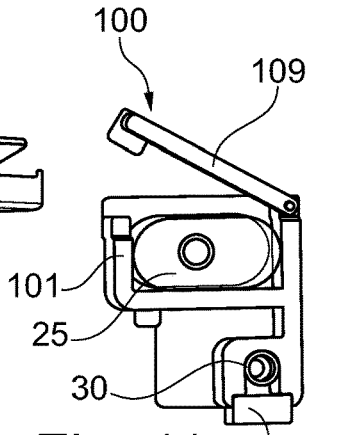
Figure 12A:
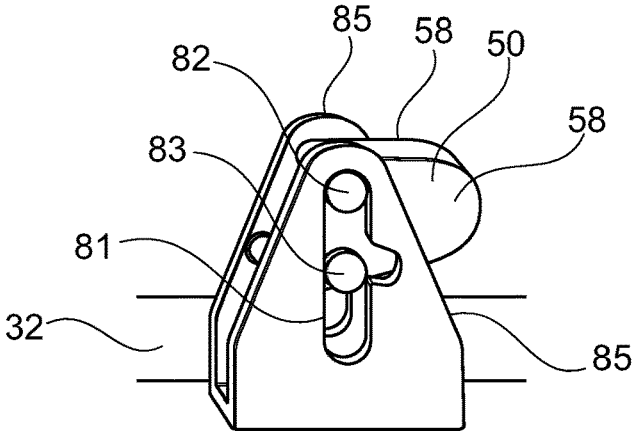
Figure 12B:
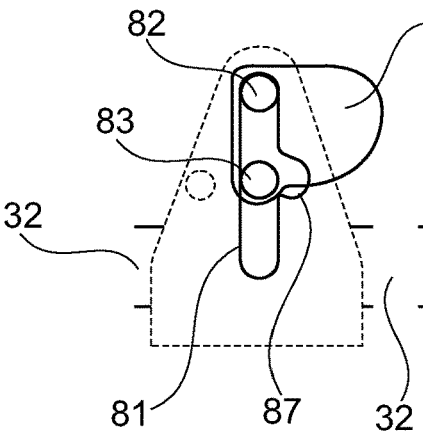
Figure 12C:
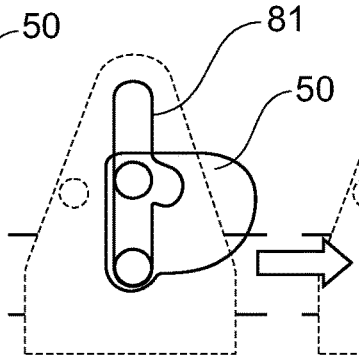
Figure 12D:
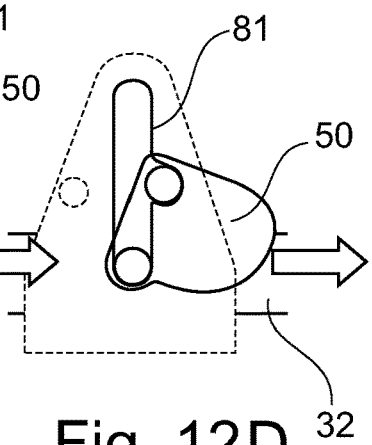
Figure 12E:
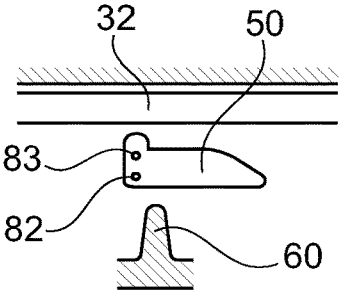
Figure 13:
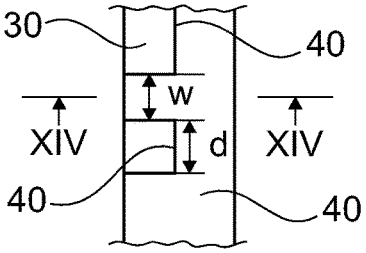
Figure 14:
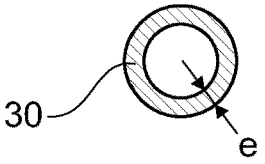
Figure 15A:
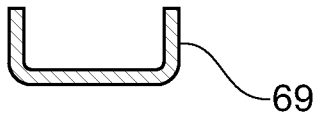
Figure 15B:
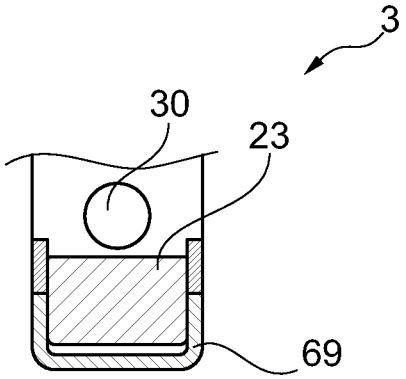
Figure 16A:
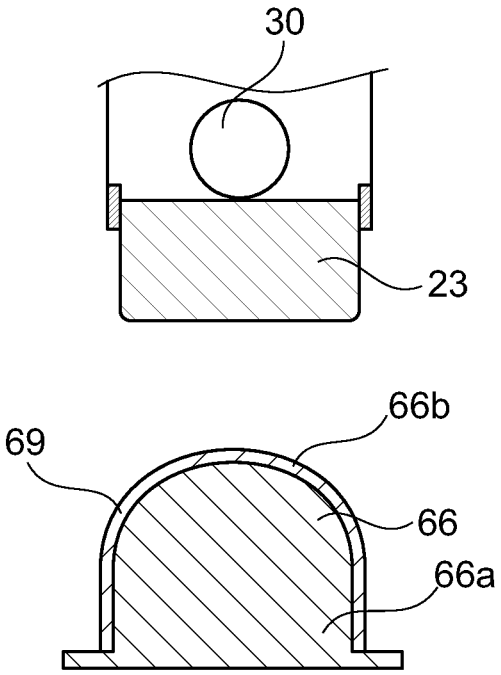
Figure 16B:
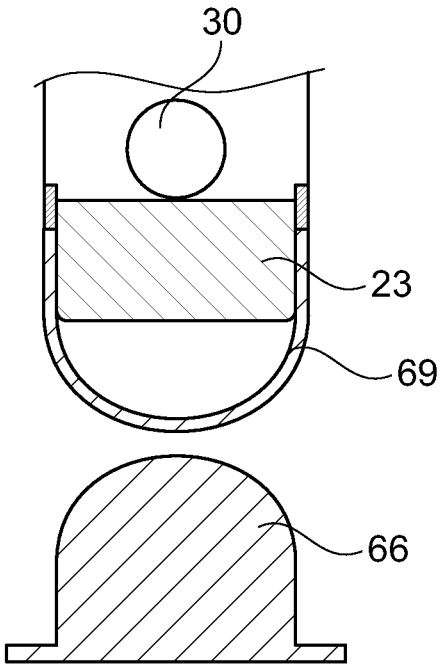
Figure 17:
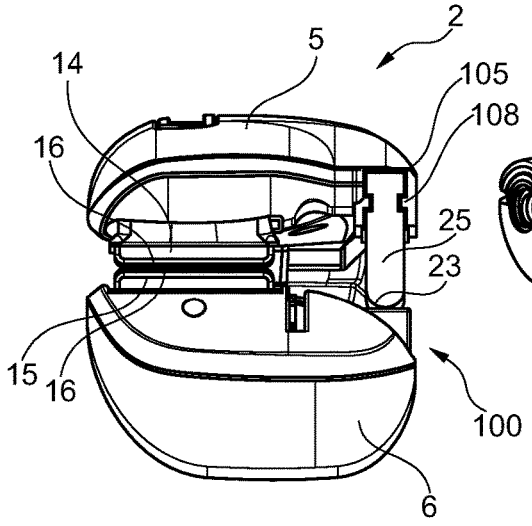
Figure 18:
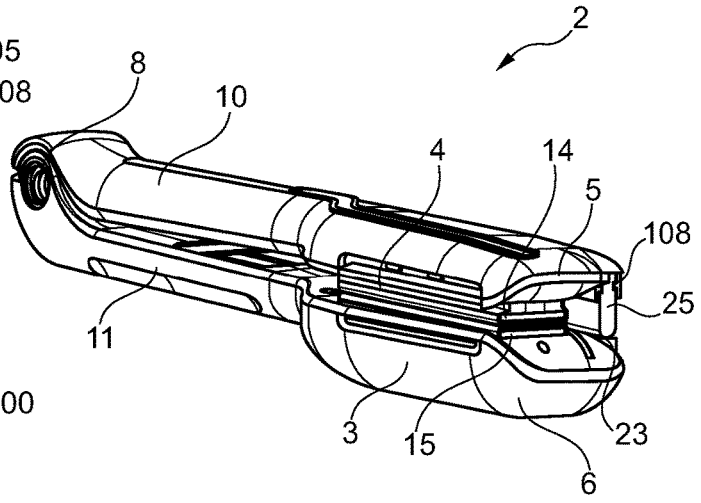
Figure 19:
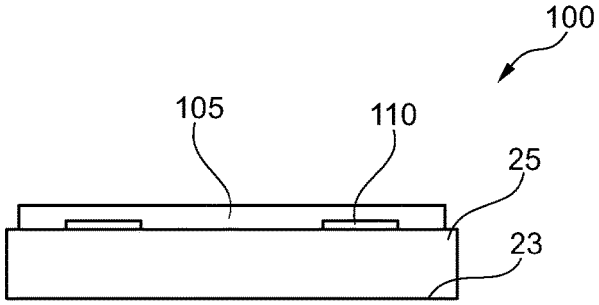
Figure 20:
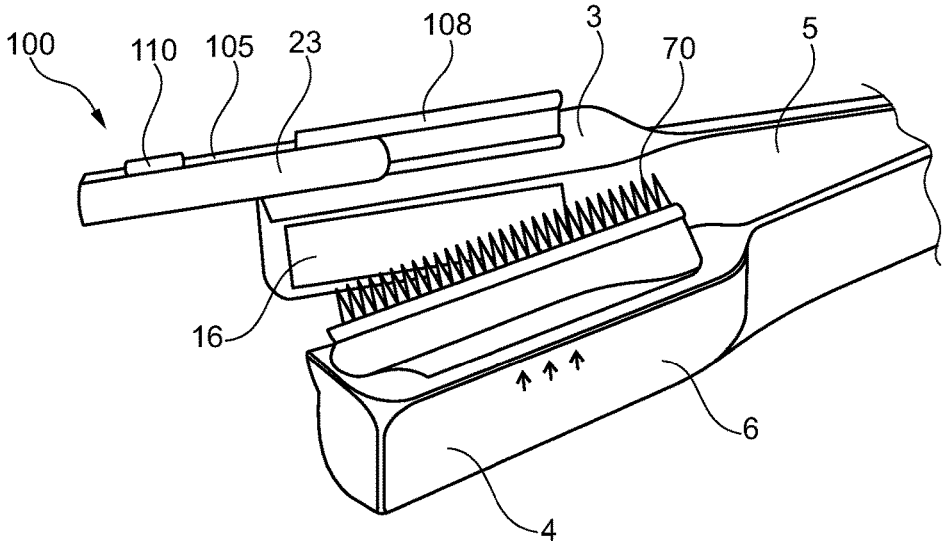

The invention may be better understood from reading the following detailed description of non-limiting implementation examples thereof and from examining the appended drawing, in which:

FIG. 1 is a schematic and partial perspective view of a handpiece produced in accordance with the invention, the jaws being in the closed configuration, FIG. 2 shows a top view of the device, with the assembly that forms a refill removed, FIG. 3 shows a top view of the lower arm on its own, FIG. 4 shows the assembly that forms a refill on its own, FIG. 5 is an exploded view showing certain components of the assembly that forms a refill, FIG. 6 is a schematic cross section through the handpiece, FIGS. 7 to 9 are views similar to FIG. 6 of variant embodiments of the handpiece, FIG. 10 is a perspective view of a variant embodiment of the assembly that forms a refill, FIG. 11 is a front view of the assembly that forms a refill from FIG. 10, FIGS. 12A to 12D illustrate the cooperation between the pressing element and the flexible duct, FIG. 12E shows a variant embodiment of the pressing element, FIG. 13 shows the dispensing end piece on its own, and FIG. 14 is a cross section along XIV-XIV in FIG. 13, FIG. 15A shows the protective cover on its own, FIG. 15B illustrates the cooperation between the protective cover and the applicator member, FIGS. 16A and 16B illustrate the use of the block as a protective cover, FIG. 17 shows a front view of a variant embodiment of the handpiece, FIG. 18 is a perspective view of the variant embodiment from FIG. 17, FIG. 19 illustrates a variant embodiment of the refill, and FIG. 20 illustrates the introduction of the refill from FIG. 18 into the handpiece.

FIG. 1 shows the handpiece 2 of an example of a device for treating the hair according to the invention.

This handpiece 2 has two jaws 3 and 4 that are able to move with respect to one another between a spaced-apart configuration (not shown) for the introduction between said jaws of a lock of hair, and a moved-together configuration for treatment, illustrated in FIG. 1.

The jaws 3 and 4 are carried by an upper arm 5 and a lower arm 6, respectively, which, in the example in question, are connected together at one end by an articulation 8, the handpiece 2 thus forming tongs.

The arms 5 and 6 define, between the articulation 8 and the jaws 3 and 4, respective half-handles 10 and 11 on which the user can press in order to move the jaws 3 and 4 together.

An elastic return member (not visible) is preferably provided to return the jaws 3 and 4 to a spaced-apart configuration, this elastic return member being for example a spring disposed around an articulation pin 8.

The invention is not limited to a particular manner of connecting the arms 5 and 6 together and the jaws 3 and 4 may be rendered able to move in some other way without departing from the scope of the present invention. However, the presence of an articulation is largely preferred for the ergonomics it provides.

The jaws 3 and 4 define between one another a region for treating the hair, said region being intended to receive a lock of hair to be treated, the handpiece 2 being moved along said lock during the treatment, for example in the direction from the root to the end of the hair.

In the example in question, the device is configured to apply a cosmetic product, to treat the hair by way of steam and to carry out a heat treatment of the hair by contact with one or more hot surfaces.

The direction D of movement of the handpiece 2 over the hair is preferably substantially perpendicular to the longitudinal axis X thereof.

The handpiece 2 is connected by a line 17, in the example in question, to a base station (not shown) that is fixed during the treatment and is connected to the mains.

This base station provides the electric power supply to the handpiece 2 and also its supply with water in order to generate steam, and may also carry out additional functions of processing electrical signals received from the handpiece 2. The line 17 which connects the handpiece 2 to the base station can thus comprise various electrical conductors and a water supply pipe.

A user interface (not shown in the figures) can be present on the handpiece so as to allow the user for example to start up certain components thereof, or not.

The heat treatment is provided by two heating elements 14 and 15, visible in particular in FIG. 6, that are carried by the upper arm 5 and lower arm 6, respectively, each having a plate that defines a hot surface 16 for bringing into contact with the hair.

The plates of the heating elements 14 and 15 are made of any material suitable for the treatment to be carried out, for example a metal, ceramic or glass.

The surface state of the plates, in the region of contact with the hair, depends on the desired treatment, and preferably the plates are smooth when the device is intended to straighten the hair.

The length l of the plates defines the extent of the treatment region perpendicularly to the direction D of movement of the handpiece 2 relative to the hair. The hot surfaces 16 defined by the plates are for example flat and have a rectangular contour, as illustrated in FIG. 3.

One of the plates is for example mounted in a fixed manner on the corresponding arm while the other is mounted in an articulated manner, for example with the aid of a ball joint, so as to allow the plates to extend parallel to one another and to a median treatment plane in the closed configuration of the jaws. If appropriate, at least one of the plates is disposed on one of the arms 5 and 6, being supported by a structure that forms a spring.

The heating elements 14 and 15 may each comprise an electrical resistor electrically powered by the base station, preferably with temperature regulation by virtue of one or more sensors disposed in the vicinity of the heating resistors or in contact with the plates.

Treatment with steam is ensured by virtue of a vaporization member 18 consisting of a resistive element provided in an evaporation chamber 19 supplied with water by the base station. The latter may comprise an electrically driven pump, preferably a peristaltic pump, that draws up water to be sent to the handpiece 2 from a reservoir of water. The pump is for example as disclosed in the publication FR 2 967 018. The evaporation chamber may be produced in accordance with the teaching in the application EP 2449909A1 or otherwise, and communicate with at least one steam outlet.

The evaporation chamber 19 is disposed on one of the arms, namely the lower arm 6 in the example in question, and the steam outlet is provided on the same arm 6.

In the example illustrated, the steam outlet is in the form of a ramp 21 with a shape that is elongate in a direction parallel to the longitudinal axis X of the handpiece 2.

The ramp 21 may comprise, as illustrated, a number of orifices 22 for spraying steam, for example between 6 and 10 orifices, which are preferably distributed evenly along the ramp 21 and each have an axis oriented substantially perpendicularly to the median treatment plane.

The vaporization member 18 is electrically powered by the base station and a temperature sensor is advantageously disposed in the evaporation chamber 19. The base station may be produced so as to control the electric power supply of the vaporization member 18 in order to keep the temperature of the steam leaving the evaporation chamber at a value of between 110° C. and 130° C.

The application of the cosmetic product is ensured by an applicator member 23, shown schematically in FIG. 6, disposed so as to come into contact with the hair extending through the treatment region.

The cosmetic product is preferably contained in a reservoir 25 carried by the upper arm 5 of the handpiece 2, this reservoir 25 being visible in FIG. 4.

The reservoir 25 is for example a flexible-walled sachet which can empty in an airless manner.

The applicator member 23 is supplied with the aid of a product dispensing mechanism which is actuated automatically during the use of the handpiece 2, for example in order to apply a quantity of product to the hair, such that a mass of one gram of hair made up of hair with a length of 20 cm receives between 0.05 and 0.4 g, better still between 0.1 and 0.2 g of product in the case of a care product, or even more in the case of thermal straightening, dyeing or chemical straightening products, the quantity received then being for example between 5 and 10 g.

The quantity of product applied to the hair may be modified with the aid of an adjusting member 62 that acts on the dispensing mechanism.

A supply system makes it possible to supply the applicator member 23 with product in some other way than by capillary action from the reservoir. This supply system comprises, in the example in question, a dispensing end piece 30, visible in FIG. 5, which is connected to the reservoir 25 by a flexible duct 32. Said reservoir 25 is preferably disposed in a removable manner on the handpiece 2 so as to be easy to replace, in particular from one use to another.

In the example in question, the applicator member 23 comprises a diaphragm made of a material that is permeable to the cosmetic product, preferably a diaphragm formed from an open-cell foam. This diaphragm 23 is carried by a support 34 which is in the form for example of an elongate frame, as illustrated in FIG. 5, and can be fixed for example by snap-fastening in a corresponding housing of the upper arm 5.

The dispensing end piece 30 is preferably designed to deliver the product in one direction through at least one dispensing orifice 40 that is visible in FIG. 13, is closed at rest and can open under the pressure of the upstream product.

In the example in question, the dispensing end piece 30 comprises a number of dispensing orifices 40 disposed in line with one another so as to deliver the product along the applicator member 23.

Preferably, the dispensing end piece 30 is elastically deformable such that the internal volume can be increased in order to collect product coming from the reservoir 25 before it is dispensed, and the dispensing orifice(s) 40 is/are designed to only open following such an increase in volume. Thus, it is possible to spread out the dispensing of product over a period of time greater than that for which the action of filling the dispensing end piece 30 lasts.

Prolonged dispensing of the product is useful in order to ensure application that is as homogeneous as possible right along the treated lock and to reduce the risk of product being present in a quantity that is not suitable.

Preferably, the supply system is designed such that the dispensing of the product after the jaws have been moved together lasts for more than 10 s, in particular between 10 and 30 s, for example around 20 s, or more or less the average time for treating a lock for most users.

A particularly simple and effective way of obtaining prolonged dispensing of the product is to use a dispensing end piece 30 with a tubular shape closed at one end, and made of an elastomeric material, for example having a hardness of Shore 55, and to provide it with a number of dispensing orifices 40 in the form of slots that are closed at rest and are capable of opening by elastic deformation under the pressure of the upstream product. The slots are preferably produced by cutting, so as to close with proper sealing at rest. The slots may be aligned along a diametric median plane of the end piece 30. The length d of each slot may range from 1 to 5 mm. The slots may have an identical length and are preferably distributed evenly along the dispensing end piece 30. The interval w between two consecutive slots is for example from 1 to 5 mm. The dispensing end piece 30 comprises for example a tubular body with a wall thickness e of between 0.3 and 2 mm, for example with an inside diameter of 3.2 mm and an outside diameter of 5 mm, and made of silicone or some other material such as EPDM (rubber).

Preferably, the applicator member 23 comes into contact with the dispensing end piece 30 next to the orifices 40 so as to absorb the product delivered thereby as soon as it exits.

Filling of the dispensing end piece 30 under pressure can be carried out in various ways. A particularly simple and effective way is to use, as illustrated in particular in FIGS. 12A to 12E, a pressing element 50 such as a roller or a cam which is able to move on the upper arm 5 so as to be able to bear, during its movement, against the flexible duct 32 connecting the reservoir 25 to the dispensing end piece 30 and to pinch it, and then to progressively squeeze it in the direction of the dispensing end piece 30 in order to drive the product contained inside the flexible duct towards the dispensing end piece, in the manner of a peristaltic pump. The duct 32 remains pinched as long as the jaws 3 and 4 are closed over the hair, this making it possible to keep the dispensing end piece 30 under pressure and to force the product to leave it through the orifices 40.

The pressing element 50 is actuated by a relief 60, such as a lug, which is carried by the lower arm 6, this relief 60 coming into contact with the pressing element 50 when the jaws are moved together.

On its opposing faces 58, the pressing element 50 may comprise two pairs 82 and 83 of lugs that are inserted into guide slots 81 provided on uprights 85. These slots are oriented substantially perpendicularly to the axis of the flexible duct 32 extending between the uprights 85. The length of the slots 81 is greater than the distance taken up by the lugs 82 and 83 on one and the same side of the pressing element 50, thereby allowing the pressing element 50 to move first of all substantially in translation, in the slots 81, in order to pinch the flexible duct 32 (FIGS. 12B and 12C), under the pushing action of the relief 60. The slots 81 each have a notch 87 which allows the pressing element 50 then to tilt, progressively squeezing the flexible duct 32, the lugs 82 engaging in the notches 87 as the pressure by the relief 60 on the pressing element 50 continues.

The relief 60 initially presses against a surface of the pressing element 50 which may be located substantially in line with the two slots 81 for guiding the pressing element 50.

Preferably, the relief 60 is carried by the adjusting member 62. The adjusting member may be a slider which is movable in the longitudinal direction X relative to the lower arm 6, so as to drive the pressing element 50 in rotation over a relatively large or small angular travel depending on its position, or even not to press at all against the pressing element 50 in an end position in order to operate the device without cosmetic product being dispensed. By virtue of the adjusting member 62, the user benefits from the possibility of acting on the flow rate of cosmetic product delivered on each closure of the jaws 3 and 4. The adjustment can be carried out continuously or incrementally, depending on the manner in which the adjusting member 62 is able to move on the arms. In the example illustrated, the adjusting member 62 is able to move continuously in a slideway 63.

FIG. 12E shows a variant pressing element 50 which has a more elongate shape, is more particularly suited to adjustment of the dose delivered by modification of the point at which the actuating relief 60 is initially pressed by the adjusting member 62.

In the example in question, the supply system for the applicator member 23 does not have a non-return valve other than at the dispensing orifices 40 of the dispensing end piece 30, thereby increasing the reliability of operation of the device by reducing the risk of blockage of a valve following a prolonged period of non-use. If appropriate, the reservoir 25 may be equipped with a filling valve, in particular when it is intended to be refilled in situ. When a pump other than a peristaltic pump as above is used to supply the applicator member with product, the supply system may comprise an additional non-return valve between the reservoir and a variable-volume chamber of the pump then used.

It is particularly advantageous for the reservoir 25, the dispensing end piece 30 and the duct 32 which connects them to be presented to the user as a unitary assembly forming a refill 100, as illustrated in FIG. 4, since this makes it easier to replace them when the product contained in the reservoir 25 is used up.

Preferably, this unitary assembly forming a refill 100 comprises a structure 101 that makes it easier to handle, such as a casing or any other form of support. In the case of a casing, the latter preferably comprises an opening for the pressing element 50 to pass through.

In the example in question, the structure 100 comprises a shell that defines a part of the back of the upper arm 5, as can be seen in particular in FIG. 1, partially covering the jaw 4 and defining the half-handle 10.

If appropriate, the unitary assembly forming a refill 100 may comprise an identifier recognized by the device, this allowing at least one of the following additional functions:

- automated adjustment of one or more operating parameters of the device depending on the knowledge of the nature of the product by the base station, which follows from the recognition of the identifier,
- display of information that guides the user in operations to be carried out depending on the nature of the product contained in the refill,
- knowledge of the capacity of the reservoir fitted and the output of a signal warning the user or preventing operation of the device when the product has been used up or is below a predefined volume, assuming that the device knows the number of doses dispensed, for example by counting the number of times that the jaws have been moved together,
- passage into a predefined state of the device, in particular a non-operating state, if the presence of the reservoir is not detected, for example output of a warning signal,
- preventing operation in the event of non-recognition of an identifier having an authentication function.

The assembly forming a refill can be identified mechanically and/or electronically. In the latter case, the assembly forming a refill may carry an electronic chip in which the useful information is contained and one of the arms may carry corresponding reading means.

The assembly forming a refill may be fitted from above, as in the example illustrated. In a variant, it may be fitted in some other way.

The applicator member 23 is disposed opposite a counter-bearing surface defined by a block 66 carried by the lower arm 6. This counter-bearing surface is preferably substantially in the form of a half cylinder of revolution, with a generatrix parallel to the axis X. The block 66 may help to channel the steam exiting the ramp 21 toward the hair. When the jaws 3 and 4 are closed, the block 66 bears against the applicator member 23. Preferably, the block 66 slightly compresses the applicator member 23, for example over a distance of between 1 and 5 mm.

The block 66 is preferably made of a plastics material.

In a variant, the block 66 may be made of felt and be impregnated with cosmetic product in order to allow the application of product. This configuration allows an application of product by the two jaws 3 and 4.

The radius of curvature of the counter-bearing surface is for example between 2 and 10 mm.

The block 66 may be able to move relative to the jaw 4 which carries it and its movement may be controlled, at least partially, by the adjusting member 62. Preferably, the latter controls the movement of the block 66 along an axis at right angles to the longitudinal axis of the jaw 4 which carries it.

The block 66 may be in a position of maximum compression of the applicator member 23 when the adjusting member 62 is in an end position, in order for the device to operate without cosmetic product being dispensed. When the jaws 3 and 4 are closed, this position may make it possible to wipe the applicator member 23 in order, in particular, to limit the quantity of cosmetic product contained in the applicator member 23 after use.

The adjusting member 62 may act on the block 66 by way of a cam that acts on a transmission disposed between the cam and the block 66.

The applicator member 23 may be covered at least partially, and better still entirely, with a removable protective cover 69, illustrated in FIGS. 15A and 15B, for preventing the application of cosmetic product to the hair and protecting and preserving the applicator member 23 impregnated with cosmetic product from the outside environment, in particular from dust and the ambient air which may dry it out.

The protective cover 69 may be rigid or semi-rigid and be secured or not secured to the handpiece 2 in a permanent manner. The protective cover 69 may be mounted in a pivoting manner on the lateral part of the jaw 3 carrying the applicator member 23. The cover may take up a first, open configuration allowing the application of cosmetic product and a second, closed configuration, following pivoting with respect to the first configuration, in particular by virtue of a hinge. In the second configuration, illustrated in FIG. 15B, the cover can come into contact with the applicator member 23 so as to at least partially cover it.

The protective cover 69 may be realized so as not to hamper the use of the device when it is in position on the applicator member 23, allowing the hair to move in contact therewith. In particular, the thickness of the protective cover 69 is preferably sufficiently small to allow a portion of hair, introduced between the jaws 3 and 4, to move relative to the latter when the handpiece 2 is drawn from the root of the hair toward the end. The protective cover 69 makes it possible to be able to straighten the hair without applying product. The user can straighten his or her hair by applying the product, then adding the protective cover 69 in order to continue straightening his or her hair without overloading it with product.

The handpiece 2 advantageously comprises a comb 70, as illustrated in particular in FIG. 2, which is preferably fastened removably to the lower arm 6. This comb 70 is produced for example from a rigid thermoplastic material and has a shape that is elongate along the longitudinal axis X of the handpiece 2.

Preferably, as illustrated, the length of the comb 70 is at least equal to that of the plates that define the hot surfaces 16. The height of the teeth 71 of the comb 70 is for example between 5 mm and 15 mm and the number of teeth between 20 and 80.

Preferably, the device is realized, as illustrated in FIGS. 1 to 6, such that a portion of hair introduced between the jaws 3 and 4, and moving relative thereto when the handpiece is drawn from the root of the hair to the end thereof, is successively subjected to exposure to the cosmetic product, by passing between the applicator member 23 and the block 66, to the steam by passing in line with the ramp 21 for spraying steam, and to a heat treatment by passing between the hot surfaces 16.

The handpiece 2 may advantageously have on its top a marker 108, visible to the user, such as an arrow, informing said user of the correct direction of movement of the device.

The comb 70 is preferably located on the lower arm 6, between the ramp 21 and the hot surfaces 16, as can be seen in particular in FIG. 2. The comb is introduced for example by being slid into its housing.

The presence of the comb 70 is advantageous in that it divides the lock into bundles, this tending to increase the contact surface of the hair with the hot surfaces 16 and to improve the straightening action. In addition, by dividing the lock, the surface area for exchange with the steam and the cosmetic product is also increased, to the benefit of the effectiveness of the treatment. The comb 70 can also help to increase the traction exerted on the hair, and this can improve the shaping thereof, in particular in the case of straightening. The comb 70 can also help to homogenize the product deposited upstream on the hair by the applicator member 23.

The steam treatment can improve the penetration of the product deposited upstream on the hair. The heat treatment makes it possible to dry the hair and to fix its shape.

Numerous modifications can be made to the device that has just been described, without departing from the scope of the present invention.

In a variant that is not illustrated, the heating elements and the associated hot surfaces are absent, the device being designed to only effect the application of the cosmetic product and the exposure to the steam, for example in the context of haircare or a dyeing treatment.

In variants that are illustrated in FIGS. 7 to 9, there are multiple heating elements on each of the arms, this being able to allow the handpiece 2 to be used in any direction of movement on the hair, if appropriate. The device may also retain a preferred direction of movement during the treatment, even when there are multiple heating elements on each of the arms.

The heating elements carried by one and the same arm may comprise plates with an identical width and operate simultaneously.

In order to obtain a symmetrical treatment regardless of the direction of movement, the device may comprise two steam outlets 21 on either side of the applicator member 23 for applying cosmetic product and between the hot surfaces 16, as illustrated in FIG. 8.

If there are multiple heating elements on each of the arms, the applicator member for applying cosmetic product may be disposed away from the heating elements, as illustrated in FIG. 9, only one steam outlet being present between the plates 16.

In the example in FIG. 9, the movement over the hair is preferably carried out such that the cosmetic product is deposited first. In a variant that is not illustrated, at least one of the heating elements is realized so as to be able to rotate in contact with the hair when the handpiece is moved along the lock to be treated, and is in the form for example of a rotary cylinder. The other heating element may have a concave curved shape, suitable for accommodating the roller when the jaws are moved together.

The steam spraying direction may be non-perpendicular to the median treatment plane, in order to increase the area impacted by the jet of steam, with an inclination of 0 to 20° with respect to the normal, for example. The jet exiting each outlet orifice of the ramp 21 (also known as a nozzle) may be sufficiently divergent to result in substantially uniform exposure of the lock in the direction of its width.

The reservoir 25 of product may be produced in some other way and be disposed differently on the handpiece, being for example contained with the supply system and the applicator member 23 in a casing 101 as illustrated in FIGS. 10 and 11, which is fixed to the upper arm 5 at the corresponding jaw 3. This casing 101 may comprise a cover 109 that opens upward, freeing up access to the reservoir 25, which may then, for example, be replaced independently of the other components of the refill 100.

As illustrated in FIGS. 16A and 16B, the block 66 may comprise a removable part 66*b* that can act as a protective cover 69 for the applicator member 23 in order to prevent the application of product, and a fixed part 66*a*. When the jaws 3 and 4 are closed, the removable part 66*b* of the block 66 may be disposed by the user on the applicator member 23 and cover the latter at least partially, better still completely, in order, in particular, to protect it and to encourage the preservation of the product.

Preferably, as illustrated in FIGS. 16A and 16B, the removable part 66*b* of the block 66 is formed so as to match the shape of the fixed part 66*a* of the block 66.

In a first configuration illustrated in FIG. 16A, the removable part 66*b* of the block 66 may be carried by the fixed part 66*a* of the block 66 and serve as a counter-bearing surface.

In a second configuration illustrated in FIG. 16B, the removable part of the block 66 may be turned round and be disposed on the jaw 3 carrying the applicator member 23, so as to cover the applicator member 23.

In the example in FIGS. 1 to 16B, the reservoir 25 and the applicator member 23 are two separate elements, the reservoir 25 supplying the applicator member 23 by an intermediate element, namely the dispensing end piece 30. In a variant, as illustrated in FIGS. 17 to 20, the reservoir 25 and the applicator member 23 may form all or part of a refill 100, illustrated in FIG. 19, which does not have such an intermediate element. As illustrated in FIG. 17, the refill 100 may comprise an absorbent element, the upper part of which forms the reservoir 25 and the lower part of which, which is in contact with the hair by way of its free end surface when the device is closed, forms the applicator member 23.

Preferably, the absorbent element is made of felt.

The refill 100 may comprise, as illustrated in FIG. 19, a support 105, preferably made of plastics material, for fixing the assembly 100 to the jaw 3 that carries it. As illustrated in FIG. 20, fixing is preferably carried out by way of lugs 110 of the support 105 that are intended to be inserted into a slideway 108 of the jaw 3.

The refill 100 may be taller than it is wide when viewed in section, as in FIG. 17. The felt contained in the refill may also be taller than it is wide.

The applicator member 23 may be wiped in an adjustable manner in some other way than by the block 66 being moved relative to the jaw.

In one variant, the device comprises a mechanism for adjusting the degree of tightening of the jaws, making it possible to tighten the jaws to a greater or lesser extent so as to wipe the applicator member to a greater or lesser degree against the counter-bearing surface. The adjusting mechanism may comprise a screw carried by one of the jaws, which is screwed to the other of the jaws and makes it possible to tighten the jaws by screwing.

The device according to the invention is preferably used with a base station; in a variant, the handpiece is autonomous, comprising the reserve of water necessary for producing steam.

The cosmetic product applied by the device according to the invention may be any type of haircare product. The expression cosmetic haircare product denotes a composition comprising one or more active ingredients for haircare use, and in particular a product as defined in directive 93/35/EC dated 14 Jun. 1993. Water in liquid or gaseous form which does not contain any additives for haircare use does not constitute a cosmetic product within the meaning of the present invention. The cosmetic product may be intended to make it easier to shape the hair. Examples of active agents are given for example in the publication US 2010/0307528 A1 in paragraphs [0031] and [0032]. The product may have an aqueous or non-aqueous base.

The dispensing mechanism actuated when the jaws are moved together may be realized with any type of pump, in particular a valve-type pump, for example having a piston that is able to move in an alternating manner in a pumping chamber, the piston being moved so as to reduce the volume of the pumping chamber each time the jaws are moved together and returning to its initial position by a reverse movement when the jaws are moved apart.

The dispensing mechanism may also comprise a pumping chamber produced with an elastically deformable wall, against which the other arm presses in order to reduce the volume thereof when the jaws are moved together and cause the product to flow back toward the applicator member. This chamber returns to its initial volume by way of its inherent elasticity when the jaws are moved apart, thereby making it possible to fill it with product coming from the reservoir. The variable-volume chamber may have a bellows, if appropriate. In the case of such a pumping mechanism, an anti-backflow valve is present between the reservoir and the pumping chamber, opening in the direction of flow from the reservoir to the pumping chamber.

The system for dispensing product may also be realized without a pump with the aid of a movable bottom that moves unidirectionally in the reservoir, this movement being brought about by the moving together of the jaws. For example, the bottom is pushed by a rod which is driven incrementally and unidirectionally in movement each time the jaws are moved together.

The supply system may also be realized so as to cause a dose of product to be dispensed only after the jaws have been moved together a predefined number of times.

A window may be provided, if appropriate, so as to allow the user to see the degree of emptying of the reservoir. In a variant, each action of moving the jaws together increments a counter which is initialized on the installation of a new reservoir, this counter being able to be used to warn the user that complete emptying of the reservoir is imminent. The counter may also be used to signal to the user that the product is ready to be dispensed, when a particular number of actuations of the jaws is necessary before the product impregnates the applicator member, given the dead volume which it is necessary to start filling before the product is dispensed. When the moving together of the jaws is detected electrically, counting can be effected electronically by the base station.

The mechanism for adjusting the quantity of product dispensed, when present, may be other than a slide and for example comprise a knob, the rotation of which acts on the degree of protrusion or the position of a relief which acts on the pressing element or on any other pump control mechanism. In a variant, the flow rate is adjusted at the arm which carries the reservoir, by virtue for example of an adjusting member which restricts the flow of the product to a greater or lesser extent or which pushes back, to a greater or lesser extent, a counter-bearing surface against which the flexible duct is compressed by the pressing roller during the operation of the peristaltic pump.

In a further variant, the system for supplying the applicator member with product is driven in a motorized manner by virtue of an electric motor housed in the arm, or possibly in the assembly that forms a refill.

In the examples which have just been described, the cosmetic product is not heated other than by heat losses due to the presence of the heating elements and the spraying of steam between the jaws. In one variant, the cosmetic product is heated by a specific heating means so as to raise the temperature thereof prior to application thereof, for example a heating resistor printed onto a sleeve through which the product passes or which is disposed on the reservoir or in contact therewith. This increase in temperature may have the effect of decreasing its viscosity and making it easier to apply.

The applicator member may be produced in some other way than with a foam, for example with a felt, a frit or a brush. When the applicator member is intended to be replaced by the user, it may be fitted or not fitted by virtue of a support to which the applicator member is fixed.

The support, when present, can be fixed in some other way than by snap-fastening, for example by being inserted into a housing in which it is retained by friction. This housing may open out, if appropriate, at its two opposite ends, and allow the automatic ejection of the applicator member present while the new one is being fitted, the latter expelling the old one by pushing it out of the housing.

The device can be used by moving the jaws along a lock in order to straighten the hair. The device can also be used by winding the lock around a jaw and unwinding it by sliding it over this jaw in order to curl the hair.

The device can be used in the hot state without steam production or without the heating elements being activated.

In one variant, the steam outlet and the applicator member occupy substantially the same position relative to the direction of movement of the device over the lock of hair. In this case, the steam outlet orifice(s) is/are formed for example through a counter-bearing surface against which the applicator member bears when the jaws are closed.

In the examples illustrated, the generation of steam takes place on the lower arm and the application of product on the upper arm. This arrangement can be reversed.

It is possible for the dispensing end piece not to be elastically deformable and the product may be dispensed only during the moving-together movement of the jaws. An elastically deformable chamber for collecting the product may also be interposed on the path of the product between the duct against which the pressing element and the dispensing end piece bear, this chamber being formed for example by a portion of elastically deformable tube or by a diaphragm that is elastically deformable or able to move without inherent elasticity but comes into abutment against an elastic return member which deforms in order to accompany the increase in volume and which generates the pressure necessary to continue dispensing the product once the jaws have been moved together.

The expression "comprising a" should be understood as being synonymous with "comprising at least one", and the limits are included in all the ranges of values indicated.

The invention claimed is:

1. A device for treating the hair, comprising:

a reservoir containing a cosmetic product to be applied, this cosmetic product being contained in the fluid state in the reservoir, a first jaw and a second jaw that are pivotable with respect to one another by an articulation and are able to take up a spaced-apart configuration for introducing a lock of hair between the first and second jaws and a moved-together configuration for treating the lock of hair, the first and second jaws being movable along the lock in this moved-together configuration, one heating element carried by one of the first and second jaws and disposed so as to come into contact with the lock of hair introduced between the first and second jaws, an applicator member for applying the cosmetic product in a liquid form, said applicator member being carried by the first jaw and being configured to come into contact with the hair in the closed position, the applicator member comprising a porous material, a steam outlet on the second jaw, for exposing the hair introduced into the device to steam, the steam outlet being configured such that only water exits from the steam outlet, the applicator member and the heating element being offset relative to a direction of movement over the lock, the second jaw not including any applicator member for applying the cosmetic product in a liquid form, wherein the steam outlet and the applicator member are offset relative to the direction of movement over the lock.

2. The device as claimed in claim 1, comprising a comb carried by one of said first and second jaws.

3. The device as claimed in claim 1, comprising at least two heating elements disposed so as to come into contact with the lock of hair introduced between the first and second jaws, each disposed on one of the first and second jaws and each disposed so as to come into contact with said lock.

4. The device as claimed in claim 3, wherein the heating element(s) define(s) hot surfaces for bringing into contact with the hair, a comb being disposed upstream of these hot surfaces.

5. The device as claimed in claim 1, wherein the steam outlet and the applicator member are offset relative to the direction of movement over the lock.

6. The device as claimed in claim 1, wherein the applicator member is supplied by a dispensing mechanism actuated by the moving together of the first and second jaws.

7. The device as claimed in claim 6, comprising:

a flexible duct through which the product flowing from the reservoir to the applicator member passes, a rotary pressing element that acts on the flexible duct in the manner of a peristaltic pump, this pressing element being carried by one of the first and second jaws, an actuating relief carried by the other of the first and second jaws, for actuating the pressing element when the first and second jaws are moved together.

8. The device as claimed in claim 6, wherein the dispensing mechanism is adjustable with the aid of an adjusting member so as to be able to modify a rate at which the applicator member is supplied with product, the second jaw comprising a block for placing the lock of hair against the applicator member, the block being able to move relative to the second jaw carrying it and its movement being controlled by the adjusting member.

9. The device as claimed in claim 8, wherein the block passes into a position of maximum compression of the applicator member on closure of the first and second jaws, when the adjusting member is in a position in which the dispensing mechanism is not actuated.

10. The device as claimed in claim 1, comprising a dispensing end piece for supplying the applicator member with product, having at least one product dispensing orifice that leads to the applicator member.

11. The device as claimed in claim 1, wherein the reservoir is offset relative to the first and second jaws.

12. The device as claimed in claim 1, wherein the reservoir comprises an absorbent element impregnated with product, the absorbent element carrying the applicator member.

13. The device as claimed in claim 1, comprising a felt defining the applicator member and at least a part of the reservoir containing the product to be applied.

14. The device as claimed in claim 13, wherein the felt is fitted by being slid over the first jaw.

15. The device as claimed in claim 1, wherein the applicator member is compressible and the device comprises a counter-bearing surface against which the applicator member is compressed when the first and second jaws are moved together.

16. The device as claimed in claim 1, comprising two heating elements disposed on one of the first and second jaws in a manner spaced apart from one another, making it possible to carry out a heat treatment by contact with the hair, the steam outlet being located between these heating elements.

17. The device as claimed in claim 1, which does not have a water reservoir carried by the same arm as the one on which the steam outlet is provided, the water being provided by a base station.

18. The device as claimed in claim 1, comprising a block carried by the second jaw, the block being produced so as to comprise a removable cover which, in order to prevent the application of cosmetic product to the hair, can take up a configuration in which it serves as a protective cover for the applicator member.

19. The device as claimed in claim 1, comprising a block carried by the second jaw, the block being a felt impregnated with cosmetic product.

20. A process for treating the hair with the aid of a treatment device as defined in claim 1, wherein, the device is moved along a lock of hair, such that the latter is exposed, in a single operation, to an application of steam, of cosmetic product and to heating in contact with a hot surface.

21. The process as claimed in claim 20, wherein the lock of hair is further combed by the device while the latter is being moved along the lock.

22. The device as claimed in claim 1, comprising only one applicator member for applying a cosmetic product.

23. The device as claimed in claim 1, wherein the steam outlet and the heating element are offset relative to a direction of movement over the lock.

24. The device as claimed in claim 1, comprising two heating elements disposed on one of the first and second jaws in a manner spaced apart from one another, making it possible to carry out a heat treatment by contact with the hair, wherein the steam is produced by a vaporization member thermally independent of the heating elements, the steam outlet being located between the heating elements.

25. The device as claimed in claim 1, comprising two heating elements disposed on one of the first and second jaws in a manner spaced apart from one another, making it possible to carry out a heat treatment by contact with the hair, wherein the steam outlet is positioned between the heating elements and the applicator member relative to a direction of movement over the lock.

26. A device for treating the hair, comprising:

a reservoir containing a cosmetic product to be applied, this cosmetic product being contained in the fluid state in the reservoir, a first jaw and a second jaw that are pivotable with respect to one another by an articulation and are able to take up a spaced-apart configuration for introducing a lock of hair between the first and second jaws and a moved-together configuration for treating the lock of hair, the first and second jaws being movable along the lock in this moved-together configuration, an applicator member for applying the cosmetic product, said applicator member being carried by the first jaw and being designed to come into contact with the hair in the closed position, the applicator member applying the cosmetic product in a liquid form, a steam outlet on the second jaw, for exposing the hair introduced into the device to steam, wherein the steam outlet and the applicator member are offset relative to the direction of movement over the lock, the applicator member being configured for applying the cosmetic product independently of spraying of the steam by the steam outlet.

27. A device for treating the hair, comprising:

a reservoir containing a cosmetic product to be applied, this cosmetic product being contained in the fluid state in the reservoir, a first jaw and a second jaw being carried respectively by an upper arm and a lower arm and that are pivotable with respect to one another by an articulation between the upper and lower arms and are able to take up a spaced-apart configuration for introducing a lock of hair between the first and second jaws and a moved-together configuration for treating the lock of hair, the first and second jaws being movable along the lock in this moved-together configuration, one heating element carried by one of the first and second jaws and disposed so as to come into contact with the lock of hair introduced between the first and second jaws, only one applicator member for applying the cosmetic product in liquid form, said applicator member being carried by the first jaw and being configured for coming into contact with the hair in the closed position, the applicator member comprising a porous material, only one steam outlet for exposing the hair introduced into the device to steam, said steam outlet being on the second jaw, the applicator member and the heating element being offset relative to a direction of movement over the lock, wherein the steam outlet and the applicator member are offset relative to the direction of movement over the lock.

* * * * *